US010369823B2

(12) United States Patent
Celinder et al.

(10) Patent No.: US 10,369,823 B2
(45) Date of Patent: Aug. 6, 2019

(54) PRINT HEAD PRESSURE DETECTION AND ADJUSTMENT

(71) Applicant: Datamax-O'Neil Corporation, Orlando, FL (US)

(72) Inventors: Thomas Axel Jonas Celinder, Singapore (SG); Karl Perry, Port Ludlow, WA (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/803,980

(22) Filed: Nov. 6, 2017

(65) Prior Publication Data

US 2019/0135002 A1 May 9, 2019

(51) Int. Cl.

| | |
|---|---|
| ***B41J 3/407*** | (2006.01) |
| ***B41J 25/312*** | (2006.01) |
| ***B41J 2/045*** | (2006.01) |
| *B41J 25/10* | (2006.01) |

(52) U.S. Cl.

CPC ..... *B41J 25/312* (2013.01); *B41J 2/04591* (2013.01); *B41J 3/4075* (2013.01); *B41J 25/10* (2013.01); *B41J 2202/30* (2013.01)

(58) Field of Classification Search

CPC .... B41J 3/4075; B41J 25/312; B41J 2202/30; B41J 11/20

See application file for complete search history.

(56) References Cited

U.S. PATENT DOCUMENTS

| | | | | |
|---|---|---|---|---|
| 5,140,340 | A | 8/1992 | Stephenson | |
| 5,451,984 | A * | 9/1995 | Takamiya | B41J 2/325 347/217 |
| 5,529,405 | A | 6/1996 | Breitenbach et al. | |
| 6,832,725 | B2 | 12/2004 | Gardiner et al. | |
| 7,038,703 | B2 | 5/2006 | Ehrhardt | |
| 7,128,266 | B2 | 10/2006 | Zhu et al. | |
| 7,159,783 | B2 | 1/2007 | Walczyk et al. | |
| 7,413,127 | B2 | 8/2008 | Ehrhart et al. | |
| 7,726,575 | B2 | 6/2010 | Wang et al. | |
| 8,294,969 | B2 | 10/2012 | Plesko | |
| 8,317,105 | B2 | 11/2012 | Kotlarsky et al. | |
| 8,322,622 | B2 | 12/2012 | Liu | |
| 8,366,005 | B2 | 2/2013 | Kotlarsky et al. | |
| 8,371,507 | B2 | 2/2013 | Haggerty et al. | |

(Continued)

FOREIGN PATENT DOCUMENTS

WO 2013163789 A1 11/2013

*Primary Examiner* — Scott A Richmond

(74) *Attorney, Agent, or Firm* — Additon, Higgins & Pendleton, P.A.

(57) ABSTRACT

A printing system includes a print station for receiving print medium traveling along a transport pathway and an adjustable print head assembly. A medium dispenser transports the print medium on the transport pathway to the print station, and a medium width sensor detects the width of the print medium. A pressure sensor arrangement detects pressure imposed by the print head assembly at points along the width of the transport pathway when an image is printed on the print medium. A monitoring subsystem in communication with the medium width sensor and the pressure sensor arrangement calculates, based upon the detected width and the detected pressure, amounts of pressure imposed by the print head assembly along the width of the print medium.

8 Claims, 9 Drawing Sheets

(56) References Cited

U.S. PATENT DOCUMENTS

| | | | |
|---|---|---|---|
| 8,376,233 | B2 | 2/2013 | Van Horn et al. |
| 8,381,979 | B2 | 2/2013 | Franz |
| 8,390,909 | B2 | 3/2013 | Plesko |
| 8,408,464 | B2 | 4/2013 | Zhu et al. |
| 8,408,468 | B2 | 4/2013 | Horn et al. |
| 8,408,469 | B2 | 4/2013 | Good |
| 8,424,768 | B2 | 4/2013 | Rueblinger et al. |
| 8,448,863 | B2 | 5/2013 | Xian et al. |
| 8,457,013 | B2 | 6/2013 | Essinger et al. |
| 8,459,557 | B2 | 6/2013 | Havens et al. |
| 8,469,272 | B2 | 6/2013 | Kearney |
| 8,474,712 | B2 | 7/2013 | Kearney et al. |
| 8,479,992 | B2 | 7/2013 | Kotlarsky et al. |
| 8,490,877 | B2 | 7/2013 | Kearney |
| 8,517,271 | B2 | 8/2013 | Kotlarsky et al. |
| 8,523,076 | B2 | 9/2013 | Good |
| 8,528,818 | B2 | 9/2013 | Ehrhart et al. |
| 8,544,737 | B2 | 10/2013 | Gomez et al. |
| 8,548,420 | B2 | 10/2013 | Grunow et al. |
| 8,550,335 | B2 | 10/2013 | Samek et al. |
| 8,550,354 | B2 | 10/2013 | Gannon et al. |
| 8,550,357 | B2 | 10/2013 | Kearney |
| 8,556,174 | B2 | 10/2013 | Kosecki et al. |
| 8,556,176 | B2 | 10/2013 | Van Horn et al. |
| 8,556,177 | B2 | 10/2013 | Hussey et al. |
| 8,559,767 | B2 | 10/2013 | Barber et al. |
| 8,561,895 | B2 | 10/2013 | Gomez et al. |
| 8,561,903 | B2 | 10/2013 | Sauerwein |
| 8,561,905 | B2 | 10/2013 | Edmonds et al. |
| 8,565,107 | B2 | 10/2013 | Pease et al. |
| 8,571,307 | B2 | 10/2013 | Li et al. |
| 8,579,200 | B2 | 11/2013 | Samek et al. |
| 8,583,924 | B2 | 11/2013 | Caballero et al. |
| 8,584,945 | B2 | 11/2013 | Wang et al. |
| 8,587,595 | B2 | 11/2013 | Wang |
| 8,587,697 | B2 | 11/2013 | Hussey et al. |
| 8,588,869 | B2 | 11/2013 | Sauerwein et al. |
| 8,590,789 | B2 | 11/2013 | Nahill et al. |
| 8,596,539 | B2 | 12/2013 | Havens et al. |
| 8,596,542 | B2 | 12/2013 | Havens et al. |
| 8,596,543 | B2 | 12/2013 | Havens et al. |
| 8,599,271 | B2 | 12/2013 | Havens et al. |
| 8,599,957 | B2 | 12/2013 | Peake et al. |
| 8,600,158 | B2 | 12/2013 | Li et al. |
| 8,600,167 | B2 | 12/2013 | Showering |
| 8,602,309 | B2 | 12/2013 | Longacre et al. |
| 8,608,053 | B2 | 12/2013 | Meier et al. |
| 8,608,071 | B2 | 12/2013 | Liu et al. |
| 8,611,309 | B2 | 12/2013 | Wang et al. |
| 8,615,487 | B2 | 12/2013 | Gomez et al. |
| 8,621,123 | B2 | 12/2013 | Caballero |
| 8,622,303 | B2 | 1/2014 | Meier et al. |
| 8,628,013 | B2 | 1/2014 | Ding |
| 8,628,015 | B2 | 1/2014 | Wang et al. |
| 8,628,016 | B2 | 1/2014 | Winegar |
| 8,629,926 | B2 | 1/2014 | Wang |
| 8,630,491 | B2 | 1/2014 | Longacre et al. |
| 8,635,309 | B2 | 1/2014 | Berthiaume et al. |
| 8,636,200 | B2 | 1/2014 | Kearney |
| 8,636,212 | B2 | 1/2014 | Nahill et al. |
| 8,636,215 | B2 | 1/2014 | Ding et al. |
| 8,636,224 | B2 | 1/2014 | Wang |
| 8,638,806 | B2 | 1/2014 | Wang et al. |
| 8,640,958 | B2 | 2/2014 | Lu et al. |
| 8,640,960 | B2 | 2/2014 | Wang et al. |
| 8,643,717 | B2 | 2/2014 | Li et al. |
| 8,646,692 | B2 | 2/2014 | Meier et al. |
| 8,646,694 | B2 | 2/2014 | Wang et al. |
| 8,657,200 | B2 | 2/2014 | Ren et al. |
| 8,659,397 | B2 | 2/2014 | Vargo et al. |
| 8,668,149 | B2 | 3/2014 | Good |
| 8,678,285 | B2 | 3/2014 | Kearney |
| 8,678,286 | B2 | 3/2014 | Smith et al. |
| 8,682,077 | B1 | 3/2014 | Longacre |
| D702,237 | S | 4/2014 | Oberpriller et al. |
| 8,687,282 | B2 | 4/2014 | Feng et al. |
| 8,692,927 | B2 | 4/2014 | Pease et al. |
| 8,695,880 | B2 | 4/2014 | Bremer et al. |
| 8,698,949 | B2 | 4/2014 | Grunow et al. |
| 8,702,000 | B2 | 4/2014 | Barber et al. |
| 8,717,494 | B2 | 5/2014 | Gannon |
| 8,720,783 | B2 | 5/2014 | Biss et al. |
| 8,723,804 | B2 | 5/2014 | Fletcher et al. |
| 8,723,904 | B2 | 5/2014 | Marty et al. |
| 8,727,223 | B2 | 5/2014 | Wang |
| 8,736,650 | B2 | 5/2014 | Bouverie et al. |
| 8,740,082 | B2 | 6/2014 | Wilz |
| 8,740,085 | B2 | 6/2014 | Furlong et al. |
| 8,746,563 | B2 | 6/2014 | Hennick et al. |
| 8,750,445 | B2 | 6/2014 | Peake et al. |
| 8,752,766 | B2 | 6/2014 | Xian et al. |
| 8,756,059 | B2 | 6/2014 | Braho et al. |
| 8,757,495 | B2 | 6/2014 | Qu et al. |
| 8,760,563 | B2 | 6/2014 | Koziol et al. |
| 8,763,909 | B2 | 7/2014 | Reed et al. |
| 8,777,108 | B2 | 7/2014 | Coyle |
| 8,777,109 | B2 | 7/2014 | Oberpriller et al. |
| 8,779,898 | B2 | 7/2014 | Havens et al. |
| 8,781,520 | B2 | 7/2014 | Payne et al. |
| 8,783,573 | B2 | 7/2014 | Havens et al. |
| 8,789,757 | B2 | 7/2014 | Barten |
| 8,789,758 | B2 | 7/2014 | Hawley et al. |
| 8,789,759 | B2 | 7/2014 | Xian et al. |
| 8,794,520 | B2 | 8/2014 | Wang et al. |
| 8,794,522 | B2 | 8/2014 | Ehrhart |
| 8,794,525 | B2 | 8/2014 | Amundsen et al. |
| 8,794,526 | B2 | 8/2014 | Wang et al. |
| 8,798,367 | B2 | 8/2014 | Ellis |
| 8,807,431 | B2 | 8/2014 | Wang et al. |
| 8,807,432 | B2 | 8/2014 | Van Horn et al. |
| 8,820,630 | B2 | 9/2014 | Qu et al. |
| 8,822,848 | B2 | 9/2014 | Meagher |
| 8,824,692 | B2 | 9/2014 | Sheerin et al. |
| 8,824,696 | B2 | 9/2014 | Braho |
| 8,842,849 | B2 | 9/2014 | Wahl et al. |
| 8,844,822 | B2 | 9/2014 | Kotlarsky et al. |
| 8,844,823 | B2 | 9/2014 | Fritz et al. |
| 8,849,019 | B2 | 9/2014 | Li et al. |
| D716,285 | S | 10/2014 | Chaney et al. |
| 8,851,383 | B2 | 10/2014 | Yeakley et al. |
| 8,854,633 | B2 | 10/2014 | Laffargue |
| 8,866,963 | B2 | 10/2014 | Grunow et al. |
| 8,868,421 | B2 | 10/2014 | Braho et al. |
| 8,868,519 | B2 | 10/2014 | Maloy et al. |
| 8,868,802 | B2 | 10/2014 | Barten |
| 8,868,803 | B2 | 10/2014 | Caballero |
| 8,870,074 | B1 | 10/2014 | Gannon |
| 8,879,639 | B2 | 11/2014 | Sauerwein |
| 8,880,426 | B2 | 11/2014 | Smith |
| 8,881,983 | B2 | 11/2014 | Havens et al. |
| 8,881,987 | B2 | 11/2014 | Wang |
| 8,903,172 | B2 | 12/2014 | Smith |
| 8,908,995 | B2 | 12/2014 | Benos et al. |
| 8,910,870 | B2 | 12/2014 | Li et al. |
| 8,910,875 | B2 | 12/2014 | Ren et al. |
| 8,914,290 | B2 | 12/2014 | Hendrickson et al. |
| 8,914,788 | B2 | 12/2014 | Pettinelli et al. |
| 8,915,439 | B2 | 12/2014 | Feng et al. |
| 8,915,444 | B2 | 12/2014 | Havens et al. |
| 8,916,789 | B2 | 12/2014 | Woodburn |
| 8,918,250 | B2 | 12/2014 | Hollifield |
| 8,918,564 | B2 | 12/2014 | Caballero |
| 8,925,818 | B2 | 1/2015 | Kosecki et al. |
| 8,939,374 | B2 | 1/2015 | Jovanovski et al. |
| 8,942,480 | B2 | 1/2015 | Ellis |
| 8,944,313 | B2 | 2/2015 | Williams et al. |
| 8,944,327 | B2 | 2/2015 | Meier et al. |
| 8,944,332 | B2 | 2/2015 | Harding et al. |
| 8,950,678 | B2 | 2/2015 | Germaine et al. |
| D723,560 | S | 3/2015 | Zhou et al. |
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | Akel et al. |

(56) References Cited

U.S. PATENT DOCUMENTS

| | | | |
|---|---|---|---|
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todesch Ini et al. |
| 9,202,458 | B2 | 12/2015 | Braho et al. |
| 9,208,366 | B2 | 12/2015 | Liu |
| 9,208,367 | B2 | 12/2015 | Wangu |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van Horn et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,443,123 | B2 | 1/2016 | Hejl |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,360,304 | B2 | 7/2016 | Chang et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein |
| 9,412,242 | B2 | 8/2016 | Van Horn et al. |
| 9,418,269 | B2 | 8/2016 | Havens et al. |
| 9,418,270 | B2 | 8/2016 | Van Volkinburg et al. |
| 9,423,318 | B2 | 8/2016 | Lui et al. |
| D766,244 | S | 9/2016 | Zhou et al. |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |
| 9,491,729 | B2 | 11/2016 | Rautiola et al. |
| 9,497,092 | B2 | 11/2016 | Gomez et al. |
| 9,507,974 | B1 | 11/2016 | Todeschini |
| 9,519,814 | B2 | 12/2016 | Cudzilo |
| 9,521,331 | B2 | 12/2016 | Bessettes et al. |
| 9,530,038 | B2 | 12/2016 | Xian et al. |
| D777,166 | S | 1/2017 | Bidwell et al. |
| 9,558,386 | B2 | 1/2017 | Yeakley |
| 9,572,901 | B2 | 2/2017 | Todeschini |

(56) References Cited

U.S. PATENT DOCUMENTS 9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0111594 A1* 4/2014 Schuh ..... B41J 11/42 347/218
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.
2015/0210199 A1 7/2015 Payne
2015/0220753 A1 8/2015 Zhu et al.
2015/0254485 A1 9/2015 Feng et al.
2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini

(56) References Cited

U.S. PATENT DOCUMENTS

2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0362267 A1* 12/2016 Figiel ..... D21F 3/06
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschinie et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 d'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delario et al.
2017/0193432 A1 7/2017 Bernhardt
2017/0193461 A1 7/2017 Jonas et al.
2017/0193727 A1 7/2017 Van Horn et al.
2017/0200108 A1 7/2017 Au et al.
2017/0200275 A1 7/2017 McCloskey et al.

* cited by examiner

| PRINTER ID | MODEL | ORIGINAL PRESSURE | | CURRENT PRESSURE | | STATUS |
|---|---|---|---|---|---|---|
| | | LEFT | RIGHT | LEFT | RIGHT | |
| 023C1112234 | PM43 | 12 | 13 | 12 | 13 | ⊘ |
| 023C1112235 | PM43 | 11 | 12 | 11 | 13 | ⊘ |
| 023C1112236 | PM43 | 10 | 11 | 10 | 10 | ⊘ |

PRINT HEAD PRESSURE DETECTION AND ADJUSTMENT

FIELD OF THE INVENTION

The present invention relates to the field of printing and, more specifically, to systems and methods for detecting and adjusting print head pressure.

BACKGROUND

Generally speaking, printing systems (e.g., printers, copiers, fax machines, etc.) include a print head or print engine for applying visual images (e.g., graphics, text, etc.) on a page, label, or other type of printable media.

A thermal printer, for example, generates pressure and heat which is delivered via a thermal print head assembly to produce an image on print media. In this regard, varying the amount of pressure and/or heat delivered by the thermal print head results in a range of darker or lighter print being applied onto the media.

Thermal printers generally require calibrating adjustments relating to the amount of pressure and/or heat that is delivered through the print head to the print media in order to achieve optimal printing output. These modifications typically require manual adjustments involving trial-and-error.

With regard to the amount of print head pressure that is delivered through the thermal print head, proper adjustment is needed in order to balance print quality (e.g., accurate black levels) with print head longevity given that high print head pressure can negatively affect the print head's life span.

A sub-aspect relating to the amount of print head pressure applied during printing relates to the pressure difference that is applied by the print head across the width of the print media (i.e., pressure bias). For example, if the print head pressure applied is greater on one side of the print medium in comparison with the other side of the print medium, the side with heavier pressure applied will have darker print in comparison to the other side which will have lighter print.

The application of unbalanced print head pressure may be particularly problematic when print media is not evenly aligned with the print head; for example, in printers where the media is aligned against the spine of the printer rather than centered on the print head (e.g., "left-adjust" printers). Notably, utilizing print media that is narrower than the total print head width tends to result in greater pressure on the side of the print media closer to the printer spine unless the print head pressure distribution across the width of the print media is properly adjusted (i.e., adjustment so equal pressure is being applied by the print head across the width of the print media).

Adjusting and calibrating the overall amount of pressure applied by a print head onto print media during printing has traditionally involved a manual process including: printing a test pattern image having a consistent side-to-side print pattern on a label or other print media (i.e., a consistent pattern across the media width); tightening or loosening an overall-pressure-adjustment screw; printing another test pattern; and repeating the procedure as needed until the applied pressure "looks right" based upon the results of the printed test pattern. In this regard, however, pressure settings that may "look right" to the operator's eye may not produce optimal images (e.g., may not actually produce a printed bar code of the desired ANSI quality) and could have negative effects for printer life span (e.g., overtightening the print head pressure adjustment resulting in premature print head failure).

Adjusting the pressure bias or pressure difference applied by the print head across the width of the print media has also traditionally involved manual adjustments. Some printers include a "left-side" and a "right-side" pressure adjustment screw, generally of the same type as described above with regard to overall print head pressure adjustment. The pressure bias adjustment or calibrating process/procedure is typically similar to the above-described process relating to adjusting overall print head pressure (e.g., the user prints a test label having a consistent side-to-side print pattern across the width of the label or other media; the user tightens or loosens one of the pressure adjustment screws; and the user repeats the process as necessary until the test pattern output "looks right" or appears the same across the media surface).

Traditional adjustment and calibration approaches, such as those described above, take a relatively long time to perform. Further, obtaining effective results is highly reliant on operator experience to determine if the print head pressure settings are optimal, and perceived results are subjective. As a result, print output may be of inferior quality and/or print head life span may be negatively affected (e.g., the print head fails at an earlier than necessary rate resulting in higher operational costs) though visual inspection appears to indicate high quality.

Therefore, a need exists for more effective printing systems and methods, including but not limited to printer systems and methods that facilitate accurate detection and adjustment of print head pressure.

SUMMARY

Accordingly, in one aspect, the present invention embraces a print station having an opening for receiving print medium traveling along a transport pathway, the print station including an adjustable print head assembly; a medium dispenser for transporting the print medium on the transport pathway to the print station; a medium width sensor configured to detect the width of the print medium on the transport pathway; a pressure sensor arrangement positioned on the transport pathway, wherein the pressure sensor arrangement is configured to detect pressure imposed by the print head assembly at a plurality of points along the width of the transport pathway (e.g., points across the print head width); and a monitoring subsystem comprising a central processing unit and memory in communication with the medium width sensor and the pressure sensor arrangement. The monitoring subsystem includes a program configured to calculate, based at least in part upon the detected width and the detected pressure, amounts of pressure imposed by the print head assembly at points along the width of the print medium.

In an exemplary embodiment, the print station is configured to print an image comprising a test pattern on the print medium and the test pattern illustrates even or uneven pressure imposed by the print head assembly during printing.

In another exemplary embodiment, the pressure sensor arrangement includes (at least) two pressure sensors positioned proximate opposite ends across the width of the transport pathway.

In yet another exemplary embodiment, a user interface display is in communication with the monitoring subsystem and the user interface display is configured to provide visual feedback including the calculated pressure imposed along the width of the print medium (from the print head).

In yet another exemplary embodiment, the visual feedback includes a graphic illustrating the degree to which the pressure amounts are unevenly distributed along the width of the print medium.

In yet another exemplary embodiment, the graphic includes a horizontal line representing the transport pathway, a second horizontal line above the first horizontal line representing the print medium, and a tilted line representing the unevenly distributed pressure amounts along the print medium.

In yet another exemplary embodiment, a network connects the monitoring subsystem to a remote device having a display, and wherein the remote device is configured to provide visual feedback to a user including the amounts of pressure imposed by the print head assembly along the width of the print medium.

In yet another exemplary embodiment, the monitoring subsystem is configured to continuously monitor the output of the medium width sensor and the pressure sensor arrangement when a series of images are printed, and wherein the monitoring subsystem is configured to provide an alert to the remote device if the amount of pressure changes during printing of the series of images.

In yet another exemplary embodiment, the alert is provided if the amount of pressure changes by an amount exceeding a pre-set threshold.

In yet another exemplary embodiment, the print station comprises adjustment mechanisms such as screws or for adjusting pressure applied by the print head assembly.

In another aspect, the present invention embraces a method including transporting print medium along a transport path including a medium width sensor; detecting the width of the print medium via the medium width sensor; transporting the print medium to a print head; detecting pressure imposed by the print head at a plurality of points along the width of the transport pathway (e.g., across the width of the print head) via a pressure sensor arrangement; calculating, based at least in part upon the detected width and the detected pressure, pressure imposed by the print head at points along the width of the print medium via a monitoring subsystem; and providing visual feedback including the calculated pressure imposed via a user interface display in communication with the monitoring subsystem.

In an exemplary embodiment, the method includes comparing the calculated pressure with stored pressure settings for the print head, and providing visual feedback including the comparison via the user interface display.

In another exemplary embodiment, the method includes printing an image on the print medium with the print head; advancing the print medium comprising the image past the print head; adjusting the amount of pressure imposed by the print head via an adjustment mechanism; printing another image (e.g., an additional image, a second image, etc.) on the print medium while the pressure sensor arrangement detects pressure imposed by the print head at points along the width of the transport pathway; and calculating, via the monitoring subsystem, based at least in part upon the detected width of the print medium and the detected pressure of the print head imposed while printing the another image, pressure imposed by the print head assembly at points along the width of the print medium while printing the additional image.

In yet another exemplary embodiment, the method includes providing visual feedback via the user interface display including the calculated amounts of pressure imposed while printing the additional image.

In yet another aspect, the present invention embraces a method including transporting print medium through a transport path past a medium width sensor and to a print head; detecting the width of the print medium; printing an image on the print medium via the print head; detecting, while printing the image, pressure imposed by the print head via pressure sensors positioned proximate opposite ends across the width of the transport path; calculating, via a monitoring subsystem, based at least in part upon the detected width of the print medium and the detected pressure, pressure imposed by the print head at points along the width of the print medium; and displaying visual feedback including the calculated pressure via a user interface display.

In an exemplary embodiment, the visual feedback includes a graphic illustrating the degree to which the pressure amounts are unevenly distributed along the width of the print medium.

In another embodiment, the image includes a test pattern image on the print medium, and the test pattern illustrates even or uneven pressure imposed by the print head assembly during printing.

In yet another exemplary embodiment, the method includes displaying, via the user interface display, an image of an exemplary test pattern image illustrating evenly distributed pressure along the width of print medium.

In yet another exemplary embodiment, the method includes comparing the test pattern image with the exemplary test pattern image, and adjusting the amount of pressure imposed by the print head via an adjustment mechanism.

In yet another exemplary embodiment, the method includes advancing the print medium comprising the first image past the print head and printing another image comprising a test pattern image on the print medium.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces printing systems including sensors and monitoring subsystems that facilitate accurate detection and adjustment of print head pressure, as well as related methods.

Figure 1:
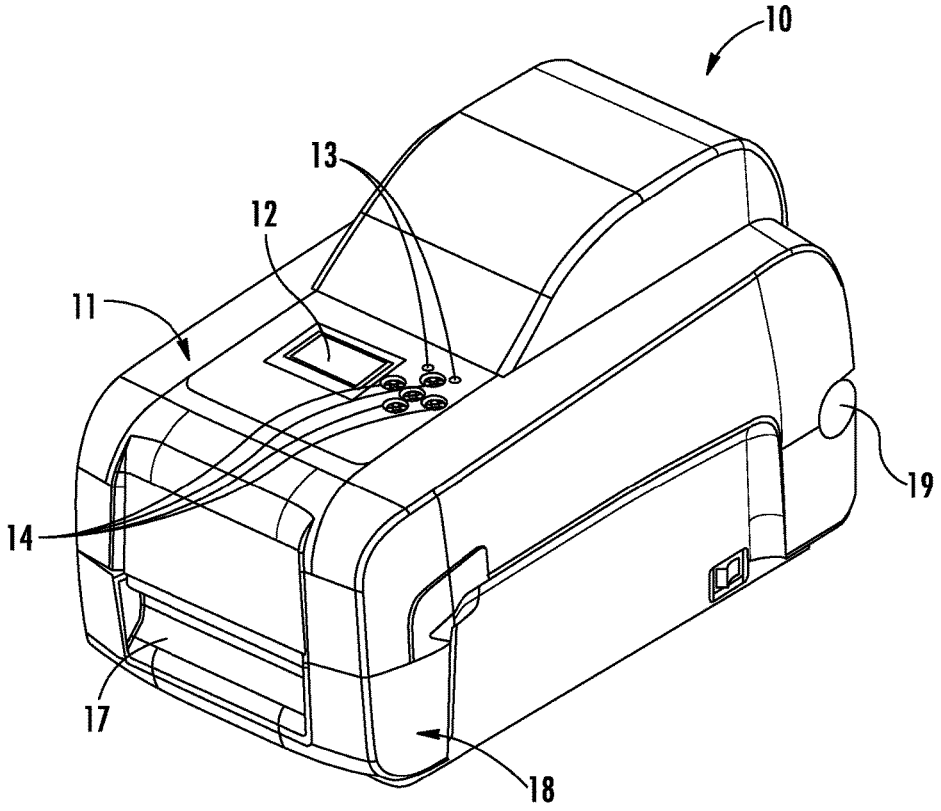
FIG. 1 depicts an exemplary printer system having a top cover in a closed position.
Figure 2:
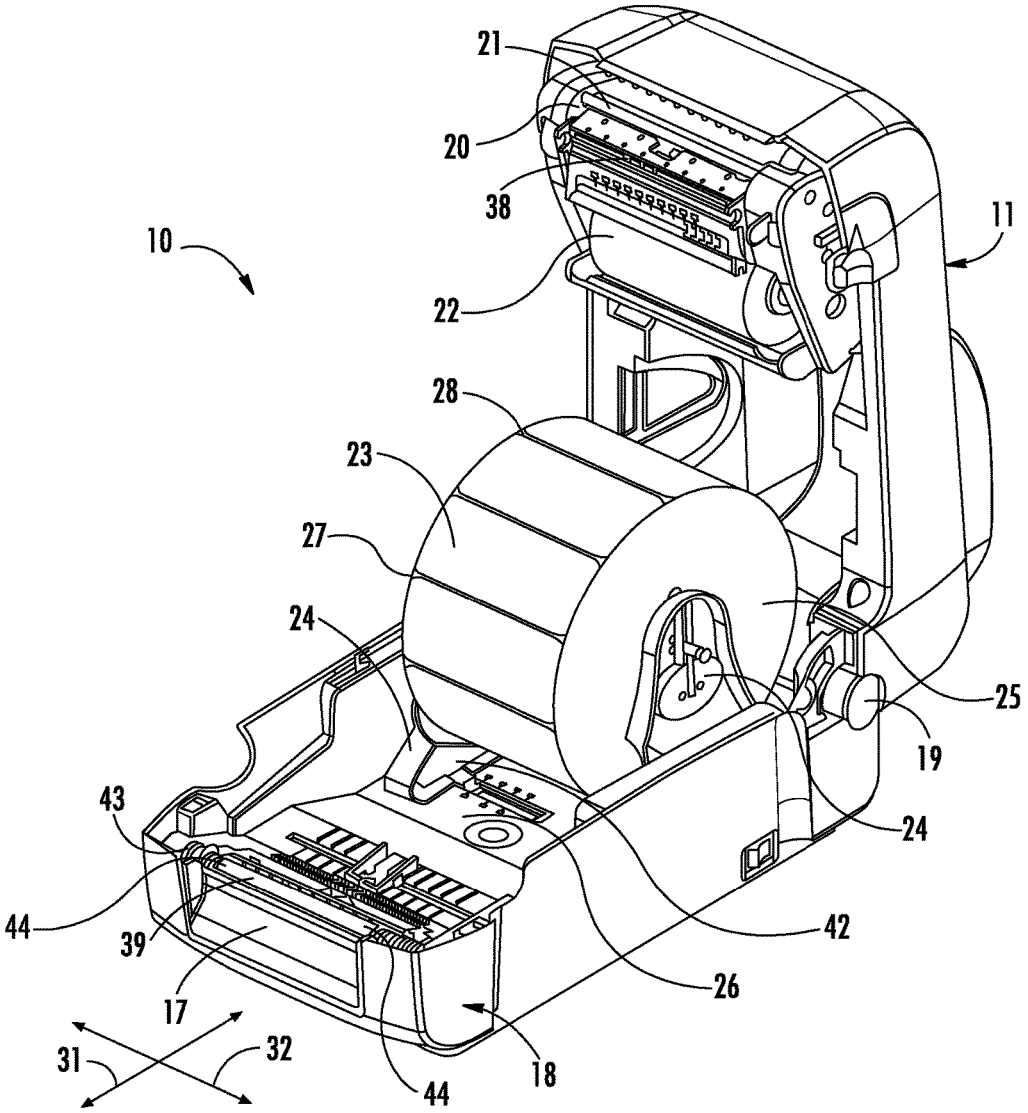
FIG. 2 depicts the exemplary printer system of FIG. 1 having a top cover in an open position.
Figure 2A:
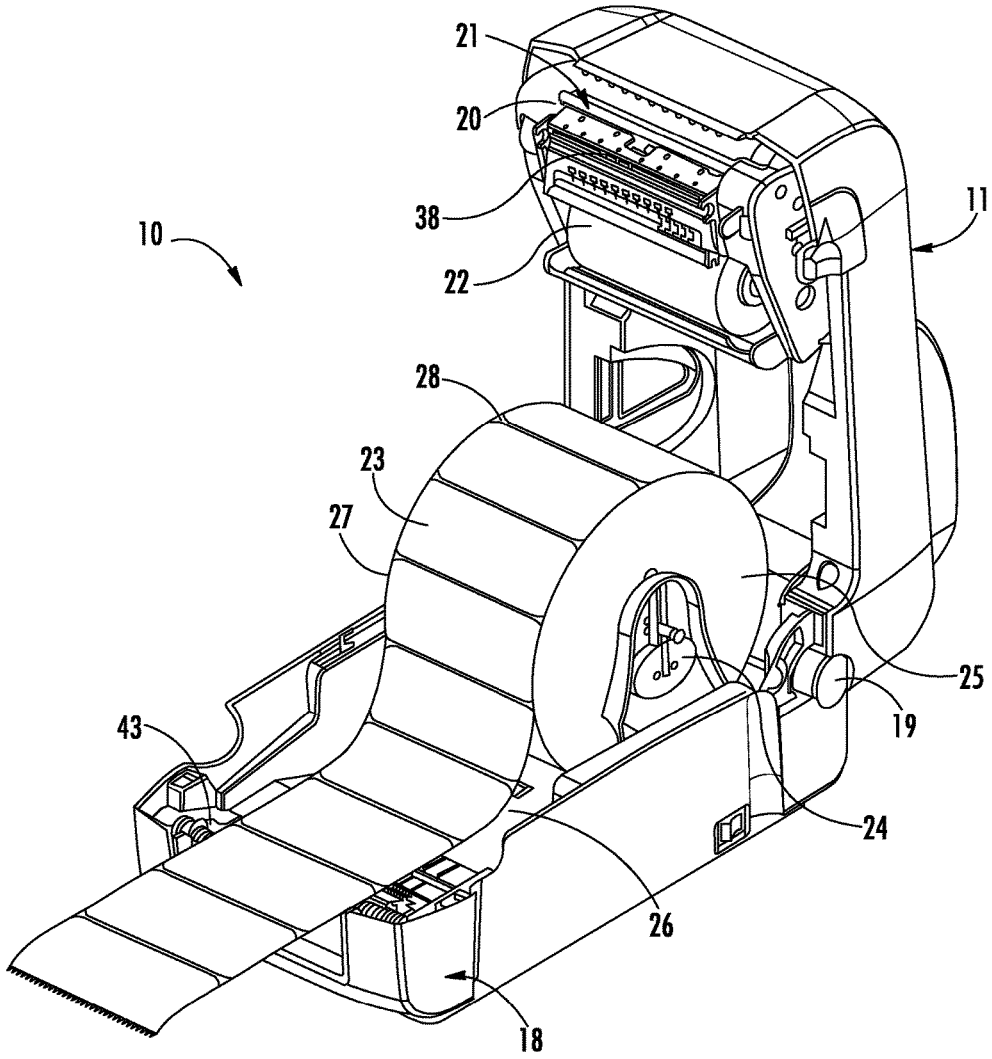
FIG. 2A depicts the exemplary printer system of FIG. 1 having a top cover in an open position and print medium positioned along media transport path.

FIGS. 1, 2, and 2A depict an exemplary printing system 10 which may include certain sensing, monitoring, and adjustment features in accord with the systems and methods of the present disclosure. Although the printing system depicted is a thermal printer 10, a thermal printer is simply one non-limiting example from a range of applicable printer systems (e.g., ink jet printer, dot matrix printer, impact printer, laser printer, etc.).

The exemplary printer 10 includes a bottom housing portion 18 and a top housing cover portion 11 which are joined by a pivoting hinge 19. The printer 10 may be placed in a closed position (as shown in FIG. 1), or in an open position (as shown in FIGS. 2 and 2A).

As shown in FIG. 1, the printer 10 can include a user interface display 12 (e.g., an LCD), one or more user input devices 14 (e.g., buttons are shown, but other input devices may be included such as a touchscreen, keypad, mouse, etc.), one or more status indicators 13 (e.g., LEDs for providing information regarding printer hardware or software operations), and a media slot 17 through which printed media exits.

As shown in FIG. 2, a print station assembly 20 is mounted within the top cover 11. The exemplary print station assembly 20 includes a ribbon supply 22 and a ribbon take up spool 21 which stream transfer ribbon for use by an adjustable print head assembly 38 during printing operations.

Figure 3:
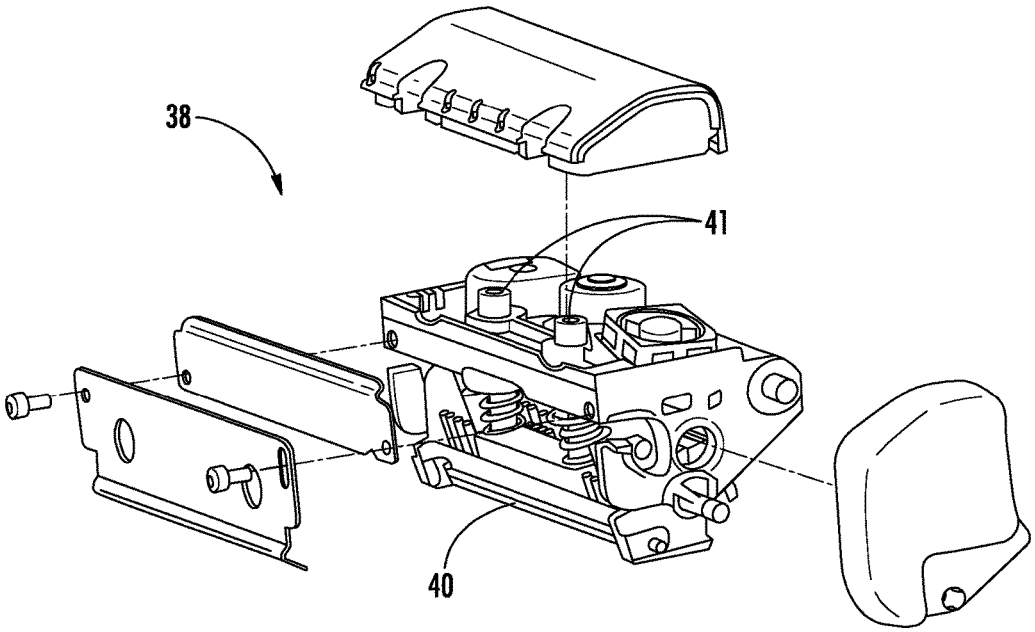
FIG. 3 depicts an exploded view of an exemplary print head assembly.

FIG. 3 depicts an exploded view of exemplary adjustable print head assembly 38, which includes a thermal print head 40 and print head pressure adjustment mechanisms 41 (e.g., screws or other devices for adjusting pressure and/or pressure bias).

As shown in FIG. 2, media support members 24 extend from the base of the bottom housing portion 18. The exemplary media support members 24 can be adjusted across a lateral axis 32 to support and facilitate use of print media 25 of various types and/or widths.

The exemplary print media 25 shown includes labels 23 (e.g., self-adhesive labels) disposed on a backing material 27. The respective labels 23 are separated by a gap 28 at which the backing material 27 is exposed.

A media dispenser 43 (e.g., operatively connected with a motor) is geared to a platen roller 39 for advancing print media 25 (e.g., labels 23 on backing 27) from the media supply roll along a media transport pathway 26 to a print head assembly 38 and, finally, through the media slot 17 (e.g., after printing). In operation, the labels 23 travel about the transport pathway 26 along a longitudinal axis 31 of the printer 10 (FIGS. 2 and 2A).

In certain exemplary embodiments, the media transport pathway 26 may include pressure sensors 44 positioned at points along the media transport pathway, for example, proximate the platen roller 39 and across the width where the print head assembly 38 makes contact to apply force or pressure to print media 25. The pressure sensor arrangement 44 is operatively connected to the printer's electronics and configured to detect and the inform printer 10 regarding the pressure or force amounts imposed by the print head assembly 38 (e.g., via monitoring subsystems controlled by a central processing unit from a stored memory location). For example, pressure readings may be obtained at points proximate the edges of the transport pathway 26 and the platen roller 39 as an image is printed on the print medium 25 or may be obtained when no image is being printed. Notably, pressure sensors 44 may be located at any number of operative positions including but not limited to the described examples, and can encompass numerous applicable sensor types.

Moreover, the media support members 24 may include print medium width sensors 42 (e.g., light-based sensors) to sense and inform the printer's electronics (via monitoring subsystems) of the width of the print media 25 that is being transported to the print station 20. Of note, although medium width sensors are advantageous for use in connection with the present disclosure, information regarding pressure and/or pressure bias standing alone still provides significant benefits. The printer 10 may further include additional sensors (not explicitly shown) for sensing and informing the printer of additional information (e.g., proper media registration).

Figure 2B:
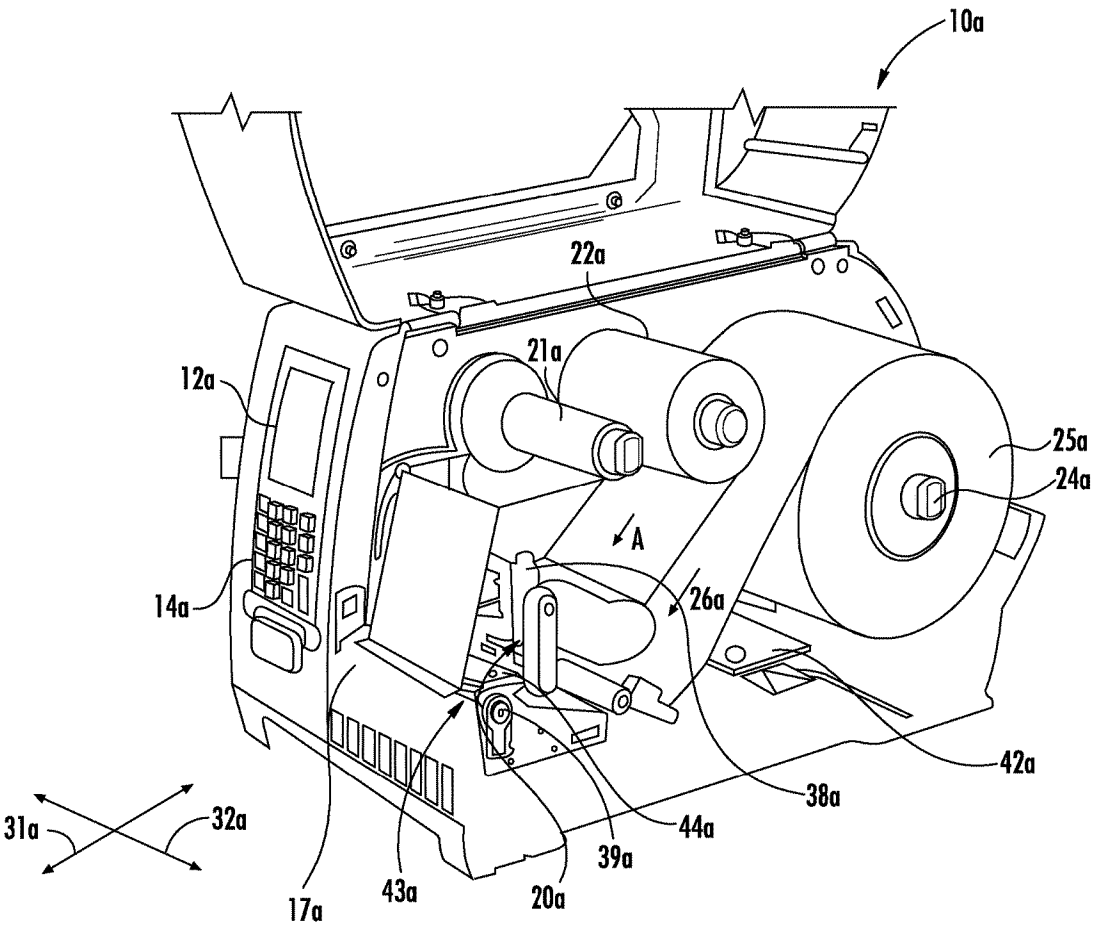
FIG. 2B depicts another exemplary printer system having a top cover in an open position.

FIG. 2B depicts another exemplary printing system 10*a* which is shown having a top/side cover in an open position. Printer 10*a* may also include certain sensing, monitoring, and adjustment features in accord with the systems and methods of the present disclosure.

In comparison to the exemplary printer 10 of FIGS. 1, 2, and 2A, printer 10*a* of FIG. 2B employs similar and/or related component types, and the respective printers perform similar functions (e.g., both are thermal printers). The related Figure(s) illustrating printers 10, 10*a* also utilize a related reference numbering scheme, for example, reference numbers 12 and 12*a* respectively refer to a user interface display (e.g., an LCD). This corresponding reference numbering scheme continues in a consistent manner with respect to the following: user input devices 14, 14*a*; media slot 17, 17*a*; print station assembly 20, 20*a*; print media 25, 25*a*; print head assembly with adjustment mechanisms 38, 38*a*; platen roller 39, 39*a*; media dispenser 43, 43*a*; and pressure sensor arrangement 44, 44*a*. A detailed description for these similar and/or corresponding components or assemblies in FIG. 2B will not be repeated with respect to printer 10*a* as the previous discussions with reference to printer 10 generally remain applicable.

In one notable aspect, however, printer 10*a* differs from printer 10 in that printer 10*a* is an exemplary left-aligned type printer as opposed to printer 10 which is an exemplary center-aligned or center-biased type printer. Although the present disclosure is applicable and advantageous for use with center-aligned type printers, the disclosed sensing, monitoring, and adjustment features will have particular relevance for use with left-aligned type printers (e.g., due to differences in the cost and the integral geometry of centering print head mechanisms as compared with left-aligned mechanisms).

In other deviating but related aspects, printer 10*a* includes ribbon supply 22*a* for providing thermal transfer ribbon (e.g., ink ribbon composed at least partially of wax and/or resin) for use by adjustable print head assembly 38*a* during printing operations (as illustrated by arrow A), and ribbon take up spool 21*a* for collecting used print ribbon. Further, the print media supply 24*a* or print roll support of printer 10*a* is in the form of a spool or hub and, accordingly, does not allow for adjustment across a lateral axis 32*a* of printer 10*a* (e.g., the media 25*a* is left-aligned against the spine of the printer). As such, medium width sensors 42*a* (if included) are positioned in an alternate arrangement (e.g., a narrow beam light transmitter and a receiver). Lastly, the print media 25*a* (e.g., label media) travels along a longitudinal axis 31*a* of the printer 10*a* via a less direct transport pathway (illustrated by arrow 26*a*) prior to exit via media slot 17*a*.

Figure 4:
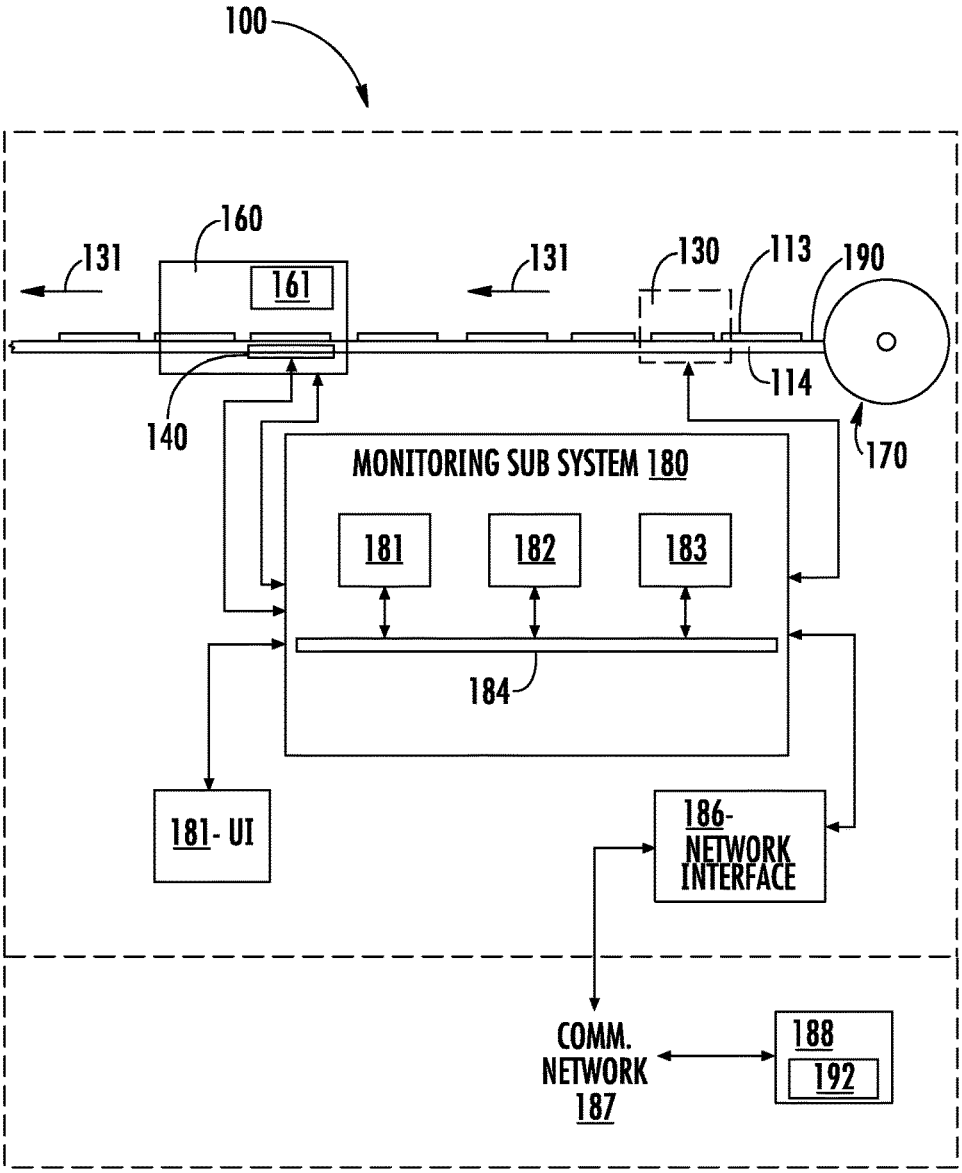
FIG. 4 is a schematic block diagram depicting certain components of an exemplary printing system.

Turning now to FIG. 4, a schematic block diagram illustrates various components of an exemplary printing system 100 of the present disclosure. Exemplary printing system 100 may incorporate certain components similar to those described above with respect to exemplary printer 10 and/or exemplary printer 10*a*.

The exemplary printing system 100 includes a print medium width sensor 130, a print station 160 with an adjustable print head assembly 161, a pressure sensor arrangement 140, a print medium dispenser assembly 170 (e.g., including a platen spindle/roller geared to a motor to advance the print media as previously described but not shown in detail in FIG. 4), and printer electronics including a monitoring subsystem 180.

Exemplary print medium 190 includes a number of labels 113 and a releasable liner 114. The labels 113 may be adhered to the liner 114 by adhesive such as, for example, a pressure sensitive adhesive layer. The exemplary media 190 supplied/transported via dispenser assembly 170 is shown as being supplied from a roll, but other types of media supplies may be utilized (e.g., fanfold media, tag or card stock, etc.).

The print medium width sensor 130 may be configured and arranged to detect the width of print media (e.g., print medium 190) as the medium type currently in use is placed or passes along a media transport pathway 131. For example, the medium width sensor 130 may include an arrangement of sensor pairs, such as a narrow beam light transmitter and a receiver, positioned at defined locations to detect/signal the media's width (e.g., a change in the detected electromagnetic radiation depending upon whether the light beam was propagated into print media). In other embodiments, the medium width sensor 130 may detect media width based upon readings from the supply roll (e.g., as described above with reference to FIGS. 2 and 2A).

The exemplary printing system 100 includes a pressure sensor arrangement 140 configured and arranged to detect forces/pressure imposed by the print head assembly 161 on the print medium 190. In some embodiments, the pressure sensor arrangement 140 can include a number (e.g., two or more) of appropriately selected pressure sensors (e.g., analog sensors using a force collector to measure strain or deflection over an area) positioned proximate opposite ends across the transport pathway (e.g., as described above with reference to FIGS. 2 and 2A). In other potential embodiments, the pressure sensor arrangement 140 may include a load sensing device for measuring deflection about a platen roller due to applied forces over the contact area of the print head assembly 161.

An exemplary monitoring subsystem 180 includes a processor 181, a memory 182, one or more signal processors 183, and a bus 184 which connects the respective components. The signal processors 183 receive signals (e.g., analog signals) from the sensors of the medium width sensor 130 and the pressure sensor arrangement 140 (e.g., using direct connection or wireless communication protocols) and provide digital output corresponding to the signals received.

In some embodiments, the monitoring subsystem 180 includes an algorithm, which may be part of a software program or firmware within the memory 182. The algorithm may be configured to calculate, based at least in part upon the detected width and the detected pressure from the medium width sensor 130 and the pressure sensor arrangement 140, estimated amounts of pressure or force imposed by the print head assembly 161 at points along the width of the print medium 190.

For example, the formula for pressure is P=F/A where P represents pressure (e.g., measured in pascals or PSI), F represents force (e.g., measured in newtons or pounds), and A represents area (e.g., measured in square meters or square inches). When the force or pressure applied at known sensor locations or points across the width of the transport pathway (e.g., at points proximate opposite ends of a platen roller as shown in FIG. 2) is supplied via the pressure sensor arrangement 140, and media width information is supplied by the medium width sensor 130, a calculated estimate of the amounts of pressure or force imposed by the print head assembly at points along the width of the print medium can be provided.

The exemplary printing system 100 includes a user interface display 185 in operable, electronic communication with the monitoring system 180. The monitoring subsystem 180 may also include software (e.g., stored in memory 182) that when executed by the processor 181 may be used to generate visual and/or audio feedback relating to the calculated pressure imposed along the width of the print medium. For example, the generated feedback may be provided via the user interface display 185.

Figures 5, 5A:
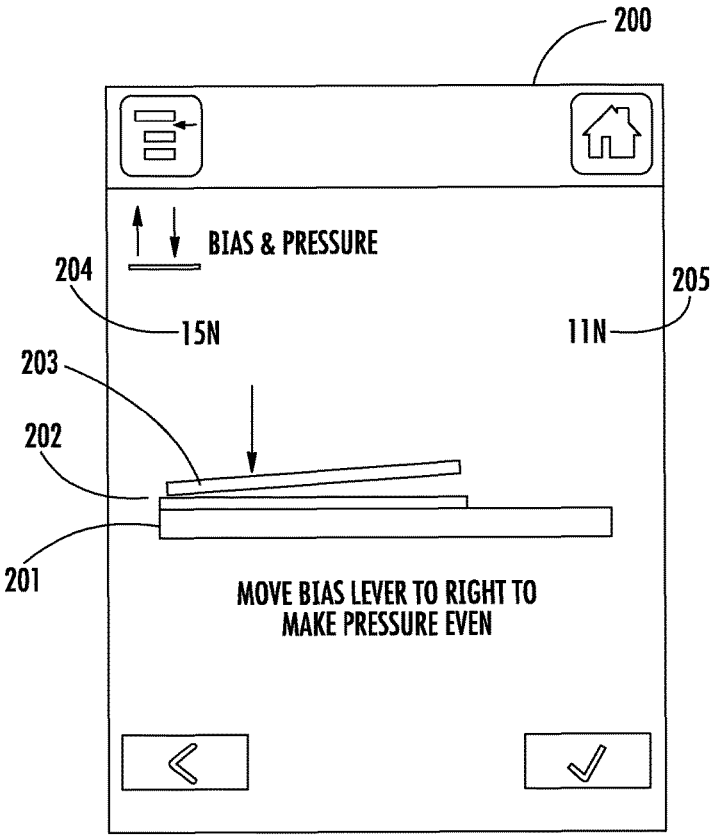
FIG. 5 depicts an exemplary display providing visual feedback.
FIG. 5A depicts another exemplary display providing visual feedback.

In one embodiment depicted in FIG. 5, the visual feedback via the user interface display 185 may include a graphic 200 illustrating, inter alia, the degree to which the estimated/calculated pressure amounts are evenly or unevenly distributed along the width of the print medium. As depicted in FIG. 5, the graphic 200 includes a horizontal line 201 representing the media transport pathway (e.g., as advanced over a platen roller), a second horizontal line 202 above the first horizontal line representing the print medium, and another line 203 which, in the depicted example, is tilted representing the unevenly distributed pressure amounts or bias imposed along the print medium. The graphic may also provide the sensor-detected amounts of force or pressure imposed by the print head assembly, such as a left-side amount 204 and a right-side amount 205. Graphic 200 is only one non-limiting example, and feedback may be provided in additional or alternative forms.

Figure 6:
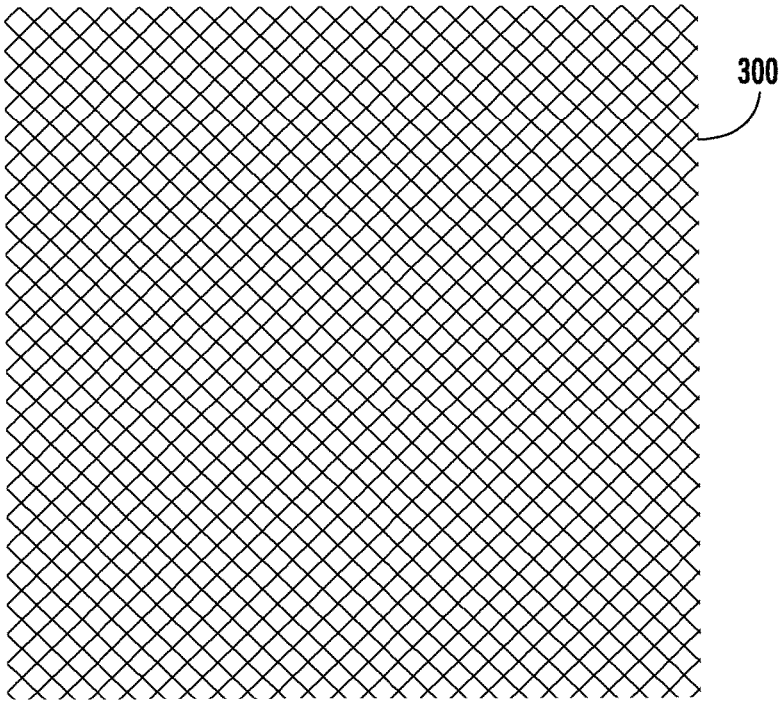
FIG. 6 depicts an exemplary test pattern image.

In addition to visual feedback being supplied via the user interface display 185 (e.g., as shown in FIG. 4), during calibration the print station 160 may be configured to print an image including a test pattern. FIG. 6 illustrates an exemplary test pattern 300 having a consistent side-to-side pattern for printing to the label media 113, or other print media (i.e., a consistent pattern across the width of the print media). In this regard, the test pattern illustrates even or uneven pressure imposed by the print head assembly during printing when viewed by a user. An exemplary diamond-shaped test pattern image 300 is depicted in FIG. 6, but other pattern types could be used (e.g., a chess board type pattern). The user interface display 185 may be configured to display a test pattern image illustrating evenly distributed pressure along the width of print medium for reference purposes to assist a user during the calibration process.

The exemplary printing system 100 of FIG. 4 may include a network interface 186 for operating in a networked environment, for example, using logical connections (e.g., using a wireless LAN ("WLAN"), Bluetooth®, Zigbee®, induction wireless, or any other suitable wireless or wired technology) to connect with one or more remote devices 188 (e.g., any network device, such as a personal computer, smartphone, tablet computer, etc.).

As illustrated in FIG. 4, the monitoring subsystem 180 is operatively connected (via network interface 186) to remote device 188 over the communications network 187. The remote device 188 includes a display 192, and the remote device may be configured to provide visual and/or other feedback to a user (e.g., a supervisor) regarding the amounts of pressure imposed by the print head assembly to the print medium 190 in a similar manner as described above with reference to the user interface display 185 (e.g., providing visual feedback as shown in FIG. 5).

In another embodiment, the remote device 188 may provide feedback to an administrator for a number of networked printing systems (not explicitly shown). For example, as illustrated in FIG. 5A, the feedback may be provided in a table/numerical format with indicators that one of the respective printing systems has pressure bias readings that are outside of acceptable ranges. For example, colored indicators (e.g., red, green, or yellow) may be provided so that the administrator can easily determine whether one of the respective printers is within, outside, and/or close to a predetermined value range that is set based upon the applicable printing hardware, quality requirements, acceptable tolerances, etc.

The monitoring subsystem 180 may be configured to continuously monitor the output of the medium width sensor 130 and the pressure sensor arrangement 140 during printing operations (e.g., when a series of images are printed). During the printing process, the monitoring subsystem 180 may be configured (e.g., via software stored in memory 182) to provide an alert or indication if the amount of pressure changes as a series of images are printed (e.g., a visual or audible alert to the remote device 188). In some embodiments, the alert or indicator could be provided if the amount of pressure bias across the width of the print media changes by an amount exceeding a pre-set threshold amount, such as if pressure bias across the media width exceeds a percentage above which printing results have been found to be unacceptable.

Figure 7:
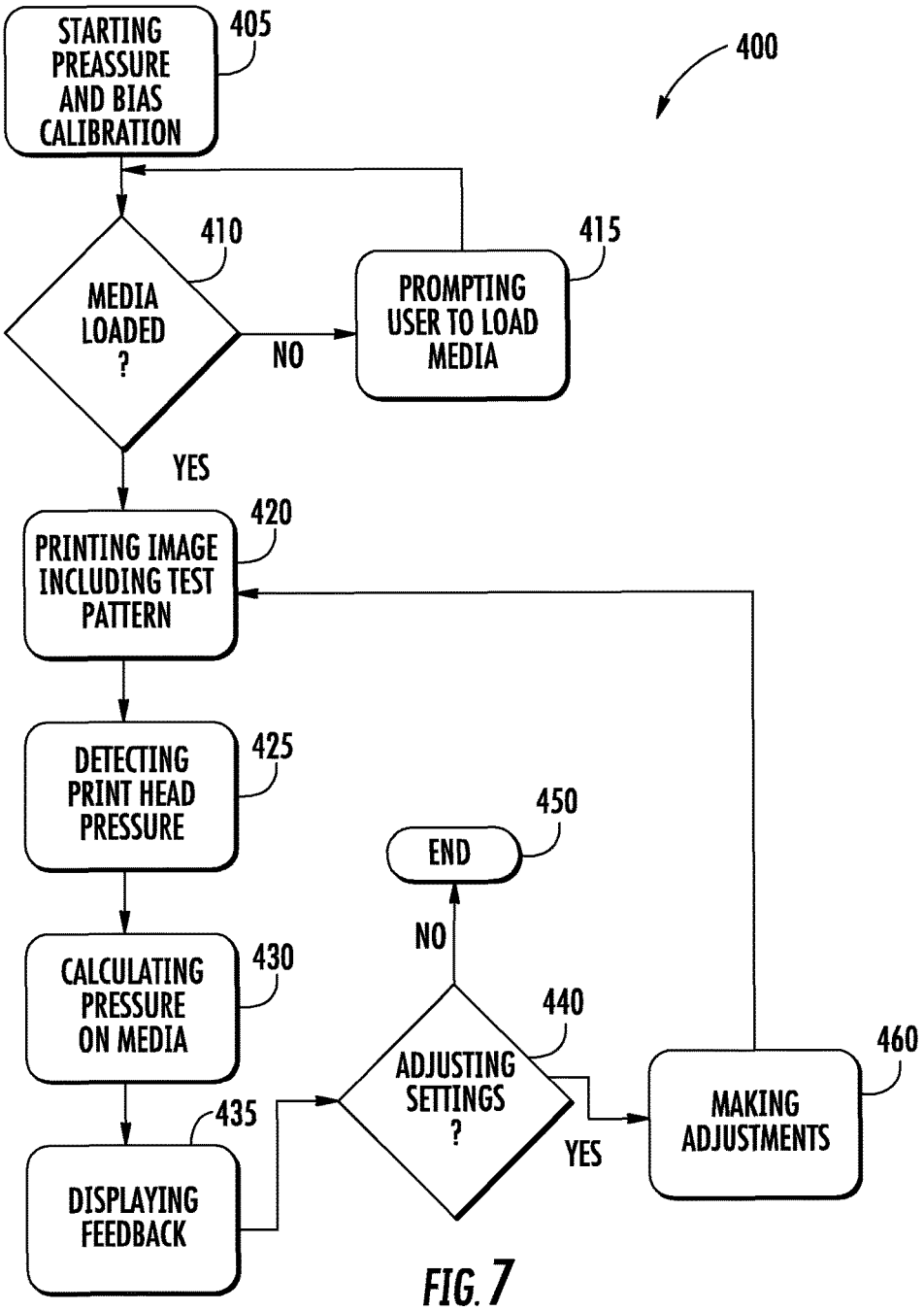
FIG. 7 is a flow chart illustrating an exemplary method for detecting and adjusting print head pressure.

Turning to FIG. 7, a flow chart illustrating an exemplary method 400 for detecting and adjusting print head pressure is shown. At step 405 a printing system receives input from a user to start a pressure and bias calibration process. For example, the user may press a "Menu" button on a printer's touch screen display, choose "Wizards" from the displayed options, choose "Calibration" from the displayed options, and then choose "Pressure and bias" from the displayed options.

At step 410, the printing system determines whether print media has been loaded, and at step 415 prompts the user via the Wizard program to load media if print media is not already loaded. If print media has been loaded, at step 420 the print system transports the print medium to a print head and begins printing an image on the print medium with the print head. The printed image may include a test pattern graphic illustrating the degree to which the pressure amounts are unevenly distributed along the width of the print medium.

At step 425, pressure sensors (e.g., positioned proximate opposite ends across the width of a print media transport path) detect pressure or force imposed by the print head.

At step 430, based at least in part upon the detected width of the print medium and the detected pressure from step 425, pressure imposed by the print head at points along the width of the print medium (e.g., pressure bias) is calculated.

At step 435, feedback including the calculated pressure imposed is displayed to a user via the print system's user interface display.

At step 440, the information on the test pattern and/or the display is evaluated so that the user can determine how to adjust or change the bias or overall pressure imposed (e.g., to improve print quality). If no adjustment is necessary, the process ends (step 450).

At step 460, the amount of pressure or bias imposed by the print head may be adjusted as necessary via an adjustment mechanism (e.g., adjustment screws). The process can then proceed by beginning back at step 420; e.g., the Wizard prompts the user to print the test pattern, the print medium including the first image is advanced past the print head, and another test pattern is printed on the print medium.

Once a satisfactory test pattern is achieved the user can end the process (step 450), for example, by exiting the Wizard. The new/adjusted pressure settings can be saved in printer firmware for use in analytics or monitoring engines.

To supplement the present disclosure, this application incorporates entirely by reference the following commonly assigned patents, patent application publications, and patent applications:

U.S. Pat. Nos. 6,832,725; 7,128,266;
7,159,783; 7,413,127;
7,726,575; 8,294,969;
8,317,105; 8,322,622;
8,366,005; 8,371,507;
8,376,233; 8,381,979;
8,390,909; 8,408,464;
8,408,468; 8,408,469;
8,424,768; 8,448,863;
8,457,013; 8,459,557;
8,469,272; 8,474,712;
8,479,992; 8,490,877;
8,517,271; 8,523,076;
8,528,818; 8,544,737;
8,548,242; 8,548,420;
8,550,335; 8,550,354;
8,550,357; 8,556,174;
8,556,176; 8,556,177;
8,559,767; 8,599,957;
8,561,895; 8,561,903;
8,561,905; 8,565,107;
8,571,307; 8,579,200;
8,583,924; 8,584,945;
8,587,595; 8,587,697;
8,588,869; 8,590,789;
8,596,539; 8,596,542;
8,596,543; 8,599,271;
8,599,957; 8,600,158;
8,600,167; 8,602,309;
8,608,053; 8,608,071;
8,611,309; 8,615,487;
8,616,454; 8,621,123;
8,622,303; 8,628,013;
8,628,015; 8,628,016;
8,629,926; 8,630,491;
8,635,309; 8,636,200;
8,636,212; 8,636,215;
8,636,224; 8,638,806;
8,640,958; 8,640,960;
8,643,717; 8,646,692;
8,646,694; 8,657,200;
8,659,397; 8,668,149;
8,678,285; 8,678,286;
8,682,077; 8,687,282;
8,692,927; 8,695,880;
8,698,949; 8,717,494;
8,717,494; 8,720,783;

8,723,804; 8,723,904;
8,727,223; 8,740,082;
8,740,085; 8,746,563;
8,750,445; 8,752,766;
8,756,059; 8,757,495;
8,760,563; 8,763,909;
8,777,108; 8,777,109;
8,779,898; 8,781,520;
8,783,573; 8,789,757;
8,789,758; 8,789,759;
8,794,520; 8,794,522;
8,794,525; 8,794,526;
8,798,367; 8,807,431;
8,807,432; 8,820,630;
8,822,848; 8,824,692;
8,824,696; 8,842,849;
8,844,822; 8,844,823;
8,849,019; 8,851,383;
8,854,633; 8,866,963;
8,868,421; 8,868,519;
8,868,802; 8,868,803;
8,870,074; 8,879,639;
8,880,426; 8,881,983;
8,881,987; 8,903,172;
8,908,995; 8,910,870;
8,910,875; 8,914,290;
8,914,788; 8,915,439;
8,915,444; 8,916,789;
8,918,250; 8,918,564;
8,925,818; 8,939,374;
8,942,480; 8,944,313;
8,944,327; 8,944,332;
8,950,678; 8,967,468;
8,971,346; 8,976,030;
8,976,368; 8,978,981;
8,978,983; 8,978,984;
8,985,456; 8,985,457;
8,985,459; 8,985,461;
8,988,578; 8,988,590;
8,991,704; 8,996,194;
8,996,384; 9,002,641;
9,007,368; 9,010,641;
9,015,513; 9,016,576;
9,022,288; 9,030,964;
9,033,240; 9,033,242;
9,036,054; 9,037,344;
9,038,911; 9,038,915;
9,047,098; 9,047,359;
9,047,420; 9,047,525;
9,047,531; 9,053,055;
9,053,378; 9,053,380;
9,058,526; 9,064,165;
9,064,165; 9,064,167;
9,064,168; 9,064,254;
9,066,032; 9,070,032;
9,076,459; 9,079,423;
9,080,856; 9,082,023;
9,082,031; 9,084,032;
9,087,250; 9,092,681;
9,092,682; 9,092,683;
9,093,141; 9,098,763;
9,104,929; 9,104,934;
9,107,484; 9,111,159;
9,111,166; 9,135,483;
9,137,009; 9,141,839;
9,147,096; 9,148,474;
9,158,000; 9,158,340;
9,158,953; 9,159,059;
9,165,174; 9,171,543;
9,183,425; 9,189,669;
9,195,844; 9,202,458;
9,208,366; 9,208,367;
9,219,836; 9,224,024;
9,224,027; 9,230,140;
9,235,553; 9,239,950;
9,245,492; 9,248,640;
9,250,652; 9,250,712;
9,251,411; 9,258,033;
9,262,633; 9,262,660;
9,262,662; 9,269,036;
9,270,782; 9,274,812;
9,275,388; 9,277,668;
9,280,693; 9,286,496;
9,298,964; 9,301,427;
9,313,377; 9,317,037;
9,319,548; 9,342,723;
9,361,882; 9,365,381;
9,373,018; 9,375,945;
9,378,403; 9,383,848;
9,384,374; 9,390,304;
9,390,596; 9,411,386;
9,412,242; 9,418,269;
9,418,270; 9,465,967;
9,423,318; 9,424,454;
9,436,860; 9,443,123;
9,443,222; 9,454,689;
9,464,885; 9,465,967;
9,478,983; 9,481,186;
9,487,113; 9,488,986;
9,489,782; 9,490,540;
9,491,729; 9,497,092;
9,507,974; 9,519,814;
9,521,331; 9,530,038;
9,572,901; 9,558,386;
9,606,581; 9,646,189;
9,646,191; 9,652,648;
9,652,653; 9,656,487;
9,659,198; 9,680,282;
9,697,401; 9,701,140;
U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;

U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;

U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;
U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;

U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A system, comprising:

a print station having an opening for receiving print medium traveling along a transport pathway, the print station including an adjustable print head assembly;

a medium dispenser for transporting the print medium on the transport pathway to the print station;

a medium width sensor configured to detect the width of the print medium on the transport pathway;

a pressure sensor arrangement positioned on the transport pathway, wherein the pressure sensor arrangement is configured to detect pressure imposed by the print head assembly at a plurality of points along the width of the transport pathway;

a monitoring subsystem comprising a central processing unit and memory in communication with the medium width sensor and the pressure sensor arrangement; and a network connecting the monitoring subsystem to a remote device having a display;

wherein the monitoring subsystem includes a program configured to calculate, based at least in part upon the detected width and the detected pressure, amounts of pressure imposed by the print head assembly at points along the width of the print medium;

wherein the remote device is configured to provide visual feedback to a user including the amounts of pressure imposed by the print head assembly along the width of the print medium;

wherein the monitoring subsystem is configured to continuously monitor the output of the medium width sensor and the pressure sensor arrangement when a series of images are printed; and wherein the monitoring subsystem is configured to provide an alert to the remote device if the amount of pressure changes during printing of the series of images.

2. The system according to claim 1, wherein the print station is configured to print an image comprising a test pattern on the print medium, and wherein the test pattern illustrates even or uneven pressure imposed by the print head assembly during printing.

3. The system according to claim 1, wherein the pressure sensor arrangement includes two pressure sensors positioned proximate opposite ends across the width of the transport pathway.

4. The system according to claim 3, comprising:

a user interface display in communication with the monitoring subsystem; and wherein the user interface display is configured to provide visual feedback including the calculated pressure imposed along the width of the print medium.

5. The system according to claim 4, wherein the visual feedback includes a graphic illustrating the degree to which the pressure amounts are unevenly distributed along the width of the print medium.

6. The system according to claim 5, wherein the graphic includes a horizontal line representing the transport pathway, a second horizontal line above the first horizontal line representing the print medium, and a tilted line representing the unevenly distributed pressure amounts along the print medium.

7. The system according to claim 1, wherein the alert is provided if the amount of pressure changes by an amount exceeding a pre-set threshold.

8. The system according to claim 1, wherein the print station comprises adjustment screws for adjusting pressure applied by the print head assembly.

* * * * *